US005209088A

United States Patent [19]

Vaks

[11] Patent Number: 5,209,088

[45] Date of Patent: May 11, 1993

[54] CHANGEABLE CODE LOCK

[76] Inventor: Rimma Vaks, 121 Elmwood Rd., Swampscott, Mass. 01907

[21] Appl. No.: 742,594

[22] Filed: Aug. 8, 1991

[51] Int. Cl.[5] ..... E05B 25/00

[52] U.S. Cl. ..... 70/384; 70/491; 70/411; 70/377

[58] Field of Search ..... 70/376, 377, 382-384, 70/403, 404, 411, 491

[56] References Cited

U.S. PATENT DOCUMENTS

| | | | |
|---|---|---|---|
| 1,720,838 | 7/1929 | De Castro | 70/491 |
| 2,557,028 | 6/1951 | Deutsch | 70/377 X |
| 3,142,167 | 7/1964 | Christopher | 70/411 |
| 3,404,548 | 10/1968 | Keefer | 70/377 X |
| 3,408,840 | 11/1968 | Hasenbein | 70/376 X |
| 3,599,455 | 8/1971 | Pilvet | 70/403 X |
| 3,817,066 | 6/1974 | Pearson | 70/411 X |
| 3,868,838 | 3/1975 | Zimmerman et al. | 70/411 X |
| 4,196,606 | 4/1980 | Guiraud | 70/491 |
| 4,934,164 | 6/1990 | Shew | 70/491 |
| 4,967,578 | 11/1990 | Sheu et al. | 70/491 |

FOREIGN PATENT DOCUMENTS

| | | | |
|---|---|---|---|
| 2313526 | 12/1976 | France | 70/491 |
| 2360730 | 3/1978 | France | 70/491 |
| 2531127 | 2/1984 | France | 70/491 |
| 515521 | 12/1939 | United Kingdom | 70/491 |

*Primary Examiner*—Peter M. Cuomo
*Assistant Examiner*—Suzanne L. Dino
*Attorney, Agent, or Firm*—Wolf, Greenfield & Sacks

[57] ABSTRACT

A cylindrical key operated variable code lock provides a shell having a cylindrical inner surface and an orifice for accepting a key. The key may be generally cylindrical in shape carrying a number of lugs thereon that are rotationally variable. The drum is normally rotationally fixed relative to the shell by a plurality of locking elements. In response to the insertion of a key having a predetermined code each of the locking elements, conversely, allow the rotation of the drum relative to the shell. The locking elements may be reconfigured in response to a predetermined varying of the key code. The reconfiguration may particularly entail the turning of the unlocked drum to a predetermined position and removing the key while the locking elements are in a state allowing recoding.

16 Claims, 3 Drawing Sheets

CHANGEABLE CODE LOCK

FIELD OF INVENTION

This invention relates to locks and more particularly to a cylindrical key operated lock in which the key code may be varied.

BACKGROUND OF INVENTION

Lock mechanisms using cylindrical keys inserted into an orifice against internal spring pressure and having a plurality of radially disposed projections for actuating corresponding internally radially disposed spring loaded tumblers are highly desirable for maximizing lock security. Such cylindrical key locks have remained relatively difficult to defeat.

However, one disadvantage to cylindrical key locks is that they are very complex and changing the key code combination is extremely costly and difficult relative to more standard flat key locks. In fact, even duplicating a key of an existing cylindrical lock is fairly costly and requires specialized equipment.

Additionally, most existing cylindrical key operated locks require substantial force to both insert the key and subsequently turn the key in order to effect locking and unlocking. Thus, to date, cylindrical key locks have been largely utilized only in high security applications such as safes, alarm systems, and extra heavy duty padlocks. Their use in household doors and for other more common locking applications has been, conversely, avoided.

SUMMARY OF INVENTION

It is therefore an object of the present invention to provide a cylindrical key locking mechanism having a changeable key code.

It is a further object of this invention to provide a cylindrical key locking mechanism that requires substantially less effort to insert and turn a key than conventional designs.

It is yet another object of this invention to provide a cylindrical key locking mechanism wherein key codes may be changed and duplicated relatively easily while security of the lock remains very high.

A variable code lock according to this invention provides an external housing having a cylindrical surface and a wall at one end thereof that carries an orifice of smaller diameter than that of the inner surface. The housing or shell carries a plurality of longitudinally disposed grooves upon its inner surface. A drum is disposed concentrically and rotationally within the cylindrical shell and carries its own plurality of longitudinally disposed slots that each correspond to one of the grooves when each of the slots and grooves are in circumferential alignment. A centrally disposed longitudinally oriented guiding rod is positioned coaxially within and rotationally fixed to the drum. This guiding rod may include ridges thereon for accepting lugs of a cylindrical key allowing direct transfer of torque between the key and the drum. A plurality of elongated tumblers are disposed in at least some of the slots that extend radially inwardly further than an edge of the orifice so as to engage the outer edges of a key placed into the orifice. The tumblers, similarly, extend radially outwardly no further than a radially outwardly disposed edge of the drum. Each of the tumblers may carry a plurality of undulations along its edge. These undulations are positioned to intermesh with corresponding undulations placed upon each of a plurality of blocks disposed and substantially radially fixed within the grooves. An annular recess is disposed within the shell about its inner circumference at a longitudinally spaced apart position from the orifice. The annular recess is sized to allow the blocks to displace circumferentially upon rotation of the drum when the blocks are positioned therein. Additionally, the shell's inner surface includes a plurality of radially outwardly disposed indentations in the region of the annular recess at positions upon the shell's circumference between each of the grooves. The indentations each carry a radially outwardly disposed depth sufficient to allow radial displacement of the blocks so that the undulations of the tumblers disengage from contact with the corresponding undulations of the blocks. In this manner, the tumblers are free to move forwardly toward the orifice while the blocks remain longitudinally stationery.

By using a key having a plurality of sleeves each carrying at least one lug thereon. Predetermined tumblers may be engaged. While the drum is positioned with each of the blocks in the indentations and the tumblers are allowed to ride forwardly toward the orifice as a key is removed, the key may be reprogrammed with a different positioning of lugs. Thus, the longitudinal versus radial code of the lugs is varied. When the key is reinserted while the blocks and tumblers are disengaged from each other, the tumblers will ride rearwardly away from the orifice to different positions. When the key is subsequently rotated the blocks will become fixed relative to the tumblers and will retain the different key code.

BRIEF DESCRIPTION OF THE DRAWINGS

The foregoing objects and advantages as well as others will become more apparent with reference to the following drawings in which.

DETAILED DESCRIPTION OF THE PREFERRED EMBODIMENT

Figure 1:
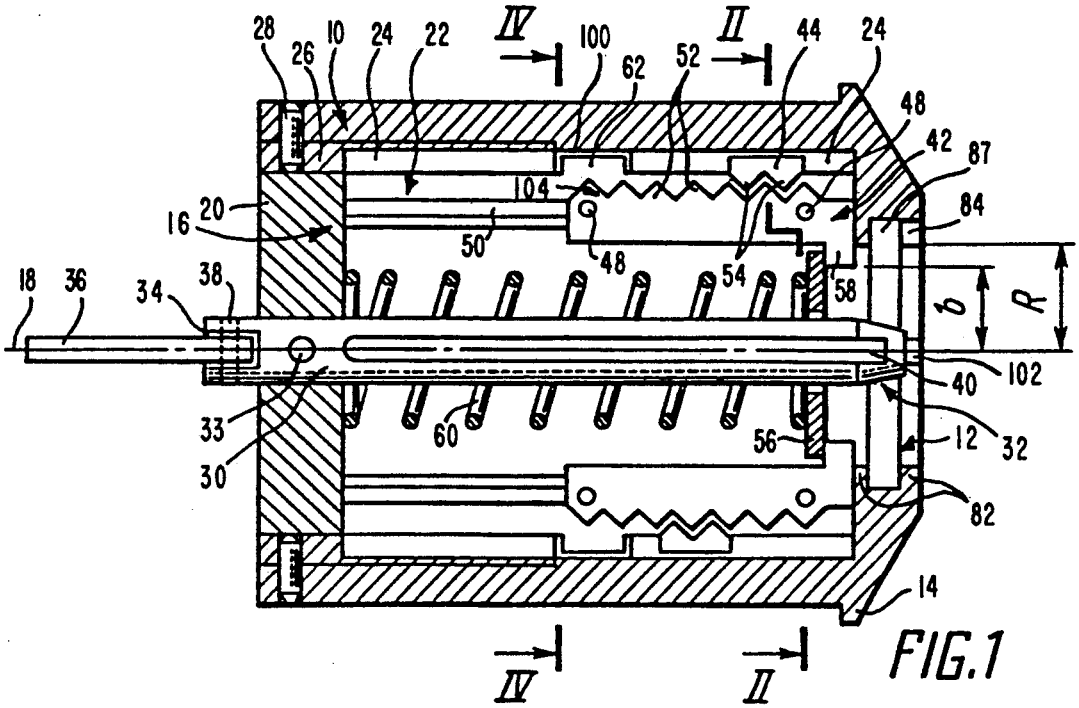
FIG. 1 is a cross-sectional side view of the locking mechanism shell and internal components according to this invention.

The cylindrical key locking mechanism according to this invention is depicted in FIG. 1. The mechanism comprises a shell 10, having an orifice 12 at an externally disposed end that in this example includes an outer rim 14 for mounting the shell 10 firmly against a surface. The rearwardly disposed portion of the shell 10, in this example, is cylindrical with a cylindrical inner surface. Disposed relatively flushly within the shell 10 is a rotatable drum 16 that is coaxial with the shell 10 about a central axis 18. The rearward most portion of the drum 16 includes a solid wall 20 in the shape of a disk. Each of these parts is constructed of stainless steel or other suitably hard material.

Figure 2:
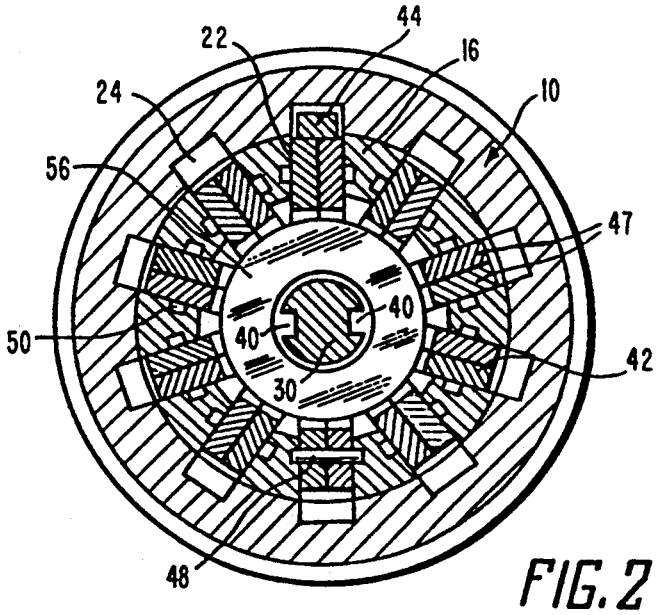
FIG. 2 is a cross-sectional front view of the mechanism taken along lines II—II of FIG. 1.

Forward of the drum wall 20 the drum 16 carries a number of slots 22 cut through its thickness. The slots 22 are, in this example, disposed radially about the circumference at evenly spaced angles as depicted in FIG. 2. In particular, the number of slots employed according to this embodiment is ten. Opposing each of the slots 22 in the drum 16 is a groove 24 in the shell 10. As will be discussed further below, these grooves 24 enable the locking and unlocking of the drum 16 relative to the shell 10. For ease of construction, according to this embodiment, the grooved inner surface 26 of the shell 10 is formed separately with longitudinal cuts that become the shell grooves 24, and the inner surface 26 is then subsequently inserted coaxially into the outer portion shell 10. The rearward most portion of the inner grooved surface 26 may be subsequently fixed in position relative to the outer portion of the shell 10 by means of radially disposed pins 28 between the inner and outer shell portions.

Extending along the central axis 18 of the locking mechanism between the mechanism's (drum's) rearward most wall 20 and forward most orifice 12 is a guiding rod 30 that is tapered at the forward most end 32 to receive a lumen of a cylindrical key and is, conversely, rotatably fixed by means of a pin 33, relative to the rearward most drum wall so that the wall 20 and drum 16 rotate simultaneously with the guiding rod 30. The guiding rod 30 extends further rearwardly posterior of the wall 20 to engage a locking bolt or other lock actuating mechanism (not shown). In this example the guiding rod 30 includes a through cut groove 34 at its exterior end with a swiveling bolt-activating tab 36 fixed thereto by means of a pin 38.

The guiding rod 30 in this example includes two opposed longitudinally oriented grooves 40. These grooves 40 allow the insertion of a corresponding cylindrical key (as shown for example, in FIGS. 5-7) having inwardly disposed lugs upon its inner luminal surface. The interconnection of the lugs and grooves 40 enables a positive transfer of torque from the key directly to the locking mechanism without overstressing the drum 16 and its associated locking components.

Figure 8:
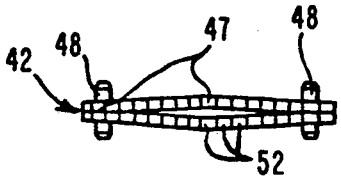
FIG. 8 is a top view of a tumbler for the locking mechanism of FIG. 1.

The locking and unlocking of the drum 16 relative to the shell 10 is accomplished particularly by means of a plurality of tumblers 42 and blocks 44 disposed between the drum slots 22 and corresponding shell grooves 24 radially about the inner circumference of the mechanism. In this example each tumbler 42 comprises an elongated pair of suitably hardened metal strips 47 joined by a pair of pins 48 (See for example FIG. 8 depicting a top view of one of the tumblers). The tumblers 42 are each oriented within one of the drum slots 22. The tumbler pins 48 extend outwardly beyond the outer most width wise edges of each tumbler 42 to engage opposing longitudinal grooves 50 cut into the side walls of each drum slot (FIGS. 2 and 8). This ensures that each tumbler 42 remains fixed in a radial direction and is, thus, allowed to move only longitudinally relative to the mechanism. Each tumbler 42 also includes, along its radially outermost edge, a series of teeth 52 or similar periodic undulations. The outermost apices of the teeth for each tumbler in a mounted position to extend radially outwardly no further than the radially outer most edge of the drum 16. In this way the tumbler 42 itself never interferes with the rotation of the drum 16 relative to the shell 10.

Each tumbler 42 faces an opposing block 44 carrying, in general, no more than two teeth 54 sized to intermesh with the teeth 52 of the tumbler 42. The block 44 rides largely within the shell's groove 24. However, the block teeth 54 extend radially inwardly into the corresponding slot 22 of the drum 16. In the position shown in FIG. 1, in which each tumbler is oriented forward most, relative to the shell orifice 12, the protruding teeth 54 of the blocks 44 cause rotational interference between the drum 16 and the shell 10 preventing the respective rotation of one to the other. Since each tumbler 42 is fixed radially (by its pins 48), and since in this forward most position each block 44 is spaced relatively closely to the bottom (radially outward most) portion of the shell groove 24, the block 44 may not move radially out of interfering contact with the drum slot 22. Thus, the drum is fully locked in this position.

In this example, the tumblers 42 are forced into a forward most locked position by means of a washer 56 bearing forcably upon respective radially inwardly protruding lugs 58 of each of the tumblers 42. The washer 56 is biased forwardly by means of a spring 60 disposed about the central axis 18 and riding over the guiding rod 30. Alternatively, however, each tumbler 42 may include its own individual compression spring disposed between its lug 58 and the rearward most wall 20 of the drum 16.

Figure 4:
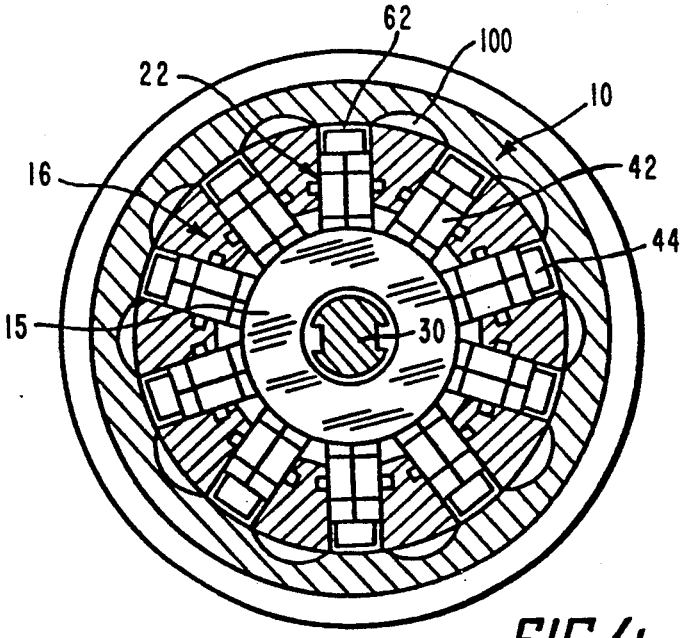
FIG. 4 is a cross-sectional front view of the lock mechanism taken along line IV—IV of FIG. 1.

As will be discussed further below, the number of teeth 52 or undulations upon each tumbler 42 is proportional to the number of possible codes for a key utilized with this locking mechanism. In this embodiment, the total number of teeth is seven, allowing five different longitudinal interfering positions for each block 44 relative to its respective tumbler 42. Interference between the shell 10 and drum 16 by means of the blocks 44 generally prevents one from rotating relative to the other. However, since unlocking is also a necessary function, the mechanism includes an annular recess 62 disposed upon the inner shell surface approximately half way between the forward most orifice 12 and rearward most wall 20 of the mechanism. This annular recess 62 is sized (in longitudinal width) to allow circumferential displacement of each block 44 when it enters the recess 62. Thus, when a particular tumbler 42 is pushed rearwardly, carrying the block 44 with it until the block 44 rests within the annular recess 62, that block is now free of the side walls of the shell groove 24 and, thus, is no longer disposed in an interfering relationship relative to the drum 16. If each tumbler 42 is pushed rearwardly so that its particular block 44 is disposed within the annular recess 62, then none of the blocks 44 continues to interfere with the rotation of the drum 16 relative to the shell 1. As such the drum 16 is then free to rotate relative to the shell 10, allowing unlocking. FIG. 4 particularly depicts the lock mechanism frontal cross section taken along the annular recess 62. At this point, the circumferential side walls of each shell groove are eliminated and, thus, the blocks 44 are unobstructed circumferentially. Since the radially outermost wall 64 of the annular recess 62 is no further radially disposed than that of the shell grooves 24, the block 44 remains fixed relative to the particular teeth 52 of the tumbler 42 upon which it rides despite its entrance into the annular recess 62. Note also that since the radially inwardly disposed teeth of each block 44 remain implanted within a respective drum slot 22, the block 44 must rotate along with the drum 16, and thus, does not become separated from its respective tumbler.

Figure 3:
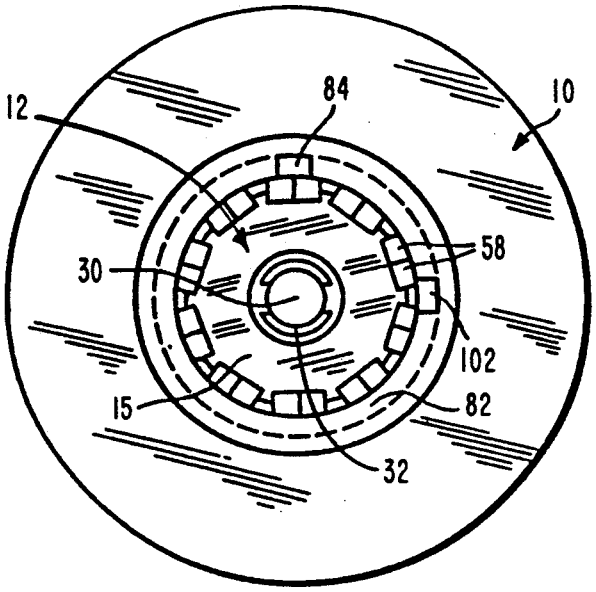
FIG. 3 is a front view of the lock mechanism of FIG. 1.
Figure 5:
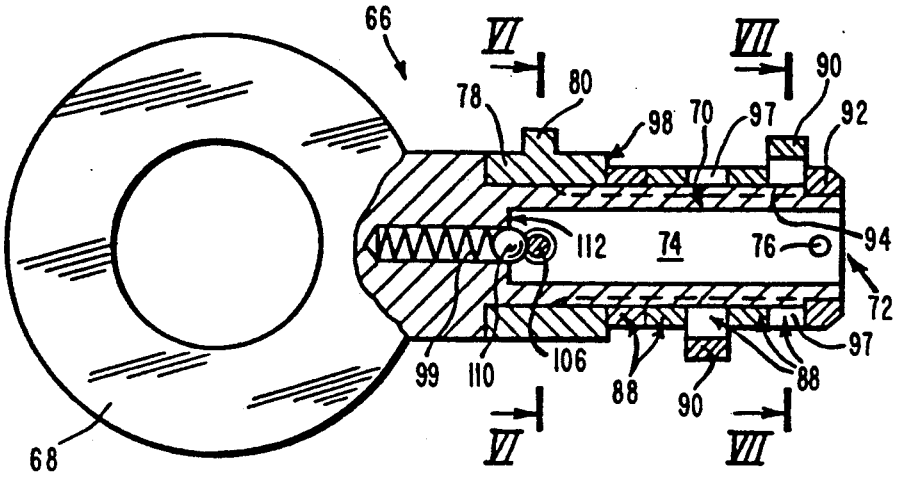
FIG. 5 is a partially exposed cross-sectional side view of a key for use with the lock mechanism of FIG. 1.
Figure 6:
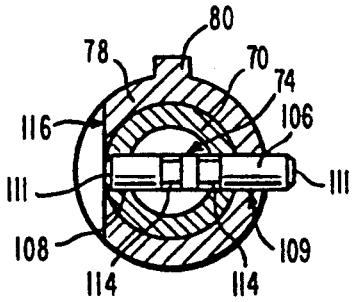
FIG. 6 is a cross-sectional front view of the key taken along lines VI—VI of FIG. 5.
Figure 7:
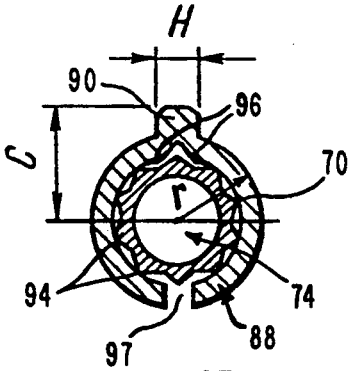
FIG. 7 is a cross-sectional front view of the key taken along lines VII—VII of FIG. 5.

A key for use with the locking mechanism of FIG. 1 is illustrated in FIGS. 5-7. This key 66 is particularly designed to facilitate longitudinal displacement of each tumbler 42 so that its respective block 44 becomes aligned with the annular recess 62 when the key 66 is fully inserted as described above. The key 66 comprises a handle 68 and, in this example, an integrally formed tubular shaft 70 projecting therefrom. The opposing end 72 of the shaft 70 from the handle 68 is open exposing a cylindrical lumen 74, the inner diameter of which corresponds roughly to that of the guiding rod 30. Near the open end 72 of the shaft 70 are also positioned two inwardly disposed pins (lugs) 76 that correspond to the grooves 40 in the guiding rod 30. Thus, the key shaft 70 may be placed uninterferringly into the orifice 12 of the locking mechanism and slides easily over the guiding rod in a predetermined rotational orientation. The outer surface of the shaft is machined with a number of tiers to accept variously configured sleeves. The rearward most of the sleeves 78 carries a rear lug 80 disposed radially outwardly at the greatest distance (C) upon the shaft 70. This rear sleeve 78 is depicted in frontal cross section FIG. 6. The rear lug 80 is disposed outwardly at a distance (C) sufficient to interfere with the outer shell orifice rim 82 as shown in FIG. 3. However, a notch 84 is cut in this rim 82, in this example, at a "12 O'clock" position that allows the rear lug having a width H to pass therethrough while the pins 76 ride upon the grooves 40 of the guiding rod 30. As such, in this position the key may be inserted fully into the locking mechanism until the rear lug 80, upon full insertion, abuts against an inwardly disposed rim 86 (FIG. 1) that prevents further inward travel of the key. The rear lug 80 is free to ride rotationally within the annular channel 87 between the inner and outer rims 86, 82. This rim 86 carries an inner diameter (radius R) less than the rear lug 80 radial spacing C and has no notch, thus preventing further insertion of the shaft at all points of rotation.

A second set of sleeves are disposed forwardly of the rear lug carrying sleeve 78. In this example, these sleeves 88 number five are of even longitudinal width disposed longitudinally in succession along the shaft 70. Each of these sleeves 88 carry at least one tumbler activating lug 90 disposed radially outwardly no further than the inner edge of the shell orifice rim (radius R). Except for the lug 90, each sleeve 88 is cylindrical with an outer diameter (radius r in FIG. 7) no larger than the innermost extension ((b) in FIG. 1) of each tumbler lug 58. Thus, the tumbler lugs are forced rearwardly only when in circumferential alignment with a particular shaft lug 90. As such, each of these shaft lugs 90 passes easily through the orifice 12 and also through the second inner disposed rim 86 that blocks the rear lug 80. The sleeves 88 are held longitudinally in place upon the shaft 70 by means of a forwardly disposed collar 92, itself held in place in this example by the pins 76 that also ride upon the guiding rod grooves 40. As depicted in cross section in FIG. 7, the key shaft 70 at the longitudinal location of each of these tumbler activating lug sleeves 88 is splined with a series of evenly circumferentially spaced longitudinal ridges or splines 94. Each tumbler activating sleeve 88, conversely, includes, proximate its lug 9, a pair of shoulders 96 upon its inner surface sized to engage the splines 94.

Each tumbler activating sleeve 88 should be constructed of a sufficiently strong spring steel. As such, if the inner diameter of each sleeve is somewhat undersized and each sleeve includes a slot 97 such as that depicted in FIG. 7, then the sleeves 88 may rotate between circumferential spline 94 positions upon the shaft 70 given application a sufficient torque. In this example, the sleeve spring force and shoulder height should be set such that firm finger pressure allows rotation of the sleeves 88 between shaft spline 94 positions.

Thus, each of the sleeves 88 may be rotated to a predetermined position, that, in this example, corresponds to one of the drum slots 22 (ten in this embodiment). In this manner, each sleeve lug 90 may access a corresponding lug 58 on a predetermined tumbler 42 and force that tumbler 42 rearwardly as the key shaft 70 is inserted into the locking mechanism. Since five sleeves 88 are provided, at most five tumblers 42 may be accessed by sleeve lugs 90 (as long as each sleeve includes only one lug). The other five tumblers are, however, also forced somewhat rearwardly in this example by means of the forwardly disposed fully circumferential shoulder 98 of the rear sleeve. As such, all tumblers 42 are forced rearwardly to at least some point making defeat of the mechanism even more difficult.

Upon assembly of the locking mechanism, the block 44 of each tumbler 42 is positioned at a predetermined location such that a given rotational setting of sleeve lugs 90 upon the key will force each block 44 into the annular recess 62 upon insertion of the key shaft 70 to its full distance within the locking mechanism. As such, the key 66 may then be freely turned leftwardly or rightwardly upon insertion, allowing locking and unlocking.

As noted, an added feature of the mechanism according to this embodiment is the ability of the possessor of the locking mechanism and key to subsequently reprogram them with a different code (i.e. resetting of rotational position of one or more sleeve 88 carrying a tumbler activating lug 90). To facilitate a code reset, the shell 10, at the location of the annular recess (see FIG. 4) includes a group of more radially outwardly disposed indentations 100 between each pair of shell grooves 24. The depth of each indentation 100 is sufficient to allow each block 44 to displace radially away from the (radially fixed) tumbler 42 far enough for the teeth of the tumbler and block 52, 54 to disengage from each other.

As depicted in FIG. 3, a second notch 102 having equal dimensions to the first "12 O'clock" notch 84 is disposed upon the outer shell orifice rim at a 90° angle thereto. Thus, the key, when turned 90°, may be removed through this notch 102. In this position, each tumbler is biased forwardly freely forwardly by the spring 60 while each corresponding block 44 is retained longitudinally within the recess 62. Note, the shell has no slots relative the circumferential position of the indentations 100 so the blocks may not move forwardly at this rotational point. Each tumbler 42 also continues to prevent its block 44 from falling completely out of the recess 62 since each tumbler's 42 rearward most end 104 is also disposed over the annular recess 62 and indentations 100.

Once the key shaft 70 is removed from the mechanism, with each block 44 seated in an indentation 100, the rotational position of each sleeve lug 90 may be reset. When the key shaft 70 is then reinserted into the lock through the 90° offset notch 102, each tumbler 42 may move rearwardly to a different longitudinal position than previously. The blocks 44, however, remain stationary throughout the key insertion and, as such, each set of block teeth 54 may now face a different set of tumbler teeth 52 than previously. Thus, as the key 66 is turned back to the "12 O'clock" position and then removed through the first notch 84 the blocks ride forwardly upon a new set of tumbler teeth 52 trapped longitudinally in their new position. At this point, the key may be subsequently reinserted and the mechanism drum 16 turned to lock and unlock using the new code.

The key and locking mechanism as described above may work effectively without further modification. However, to ensure that the user cannot inadvertently reprogram the locking mechanism, and so that the code may not become inadvertently lost, the rearward most sleeve 78 includes a second radially movable pin 106. The pin 106 rides within holes 108, 109 placed respectively diametrically through the key shaft 70 and rear sleeve 78 upon a spring 99 loaded ball 110 disposed within the rearward base 112 of the key lumen (FIG. 5). The ball 110 holds the pin 106 in either an extended and retracted position relative to the outer surface of the rear sleeve 78 while allowing its forcible movement therebetween. In particular, a pair of grooves 114 are machined into the pin 106 upon which the ball 110 seats. The ball 110, thus, provides some resistance to lateral shifting of the pin 106 that may be overcome by sufficient finger pressure. Beveled edges 111 are provided to make finger actuation easier. The pin 106 secondarily serves to maintain the rearward most sleeve 78 rotationally fixed upon the key shaft. The sleeve 78 includes a tangential slot 116 upon one side (note FIG. 6) allowing easier movement of the pin 106 into an extended position (as shown).

During normal use, both the rear lug 80 and the pin 106 should remain in a fully extended position. As such, the key may only be inserted with the rear lug 80 placed through the "12 O'clock" notch 84 in the orifice rim 82. The pin 106, in its extended position, simultaneously passes through the 90° offset notch 102 without interference, but no other rotational positioning allows such passage. When the key is turned, at least one of either the pin 106 or rear lug 80 always rests upon a part of the shell orifice rim 82. As such, the key may only be removed from the locking mechanism again in its initial "12 O'clock" position. As such, the tumblers are never allowed to ride forwardly while the blocks are in the indentations (since the key may not be removed in this position). This prevents inadvertent resetting of the blocks during normal use.

When the user desires, however, to change the key code, the user must retract the pin 106 into the shaft 70 so that it is flush with the outer surface of the rear sleeve 78 and, thus, in a non-interfering position relative to the entire inner circumference of the shell orifice rim 82. Then, following full shaft 70 insertion, the shaft 70 may be subsequently removed by passing the rear lug 80 (the only lug extended) through the 90° offset notch 102 wherein the blocks 44 are trapped in respective indentations 100 while the tumblers 42 ride forwardly. Each tumbler activating sleeve lug 90 may be subsequently rotationally repositioned and the key shaft 70 may then be reinserted to carry out the change of the code. Upon turning and removal of the newly coded key through the "12 O'clock" notch 84, the pin 106 may then be replaced into an extended position in which insertion and removal is only possible through the "12 O'clock" position, again preventing inadvertent recoding of the blocks 44 and tumblers 42.

It should be understood that the preceding is merely a detailed description of the preferred embodiment. It should be apparent to those skilled in the art that various modifications and equivalents may be made without departing from the spirit or scope of the invention. The preceding description is meant to be taken only by way of example and to describe only a preferred embodiment and not to otherwise limit the scope of the invention.

What is claimed is:

1. A variable code lock for use with a cylindrical key comprising:

an external shell having a cylindrical inner surface and a wall at one end thereof having an orifice of smaller diameter than that of the inner surface, the inner surface having a plurality of longitudinally disposed grooves thereon and an annular recess longitudinally spaced from the orifice;

a drum disposed coaxially and rotationally within the shell and having a plurality of longitudinally disposed slots thereon each circumferentially corresponding to one of the grooves;

a centrally disposed longitudinally oriented guiding rod rotationally fixed to and coaxial with the drum;

a plurality of tumblers disposed in at least some of said slots extending radially inwardly further than an edge of the orifice and extending radially outwardly no further than a radially outwardly disposed edge of the drum, the tumblers each carrying a plurality of undulations;

a plurality of blocks disposed and substantially radially fixed within the grooves having corresponding undulations that radially extend to interengage with the undulations of each of the tumblers;

wherein the insertion of the cylindrical key having the predetermined code longitudinally through the orifice disposes each of the blocks within the recess of the shell to enable the drum to rotate circumferentially without interference and wherein the annular recess is constructed and arranged to allow the blocks to displace circumferentially therein;

a plurality of radially outwardly disposed indentations located upon the inner surface of the shell within the annular recess at positions upon a circumference of the inner surface between each of the grooves, the indentations each having a radially outwardly disposed depth sufficient to allow radial displacement of the blocks away from the tumblers, so that the undulations of the tumblers disengage from interengaging contact with the corresponding undulations of the blocks, the blocks in the indentations remaining longitudinally fixed in the annular recess and the tumblers being movable in corresponding slots toward the orifice;

the orifice being constructed and arranged so that the key can be inserted therethrough and removed therefrom only when the blocks are positioned within predetermined grooves and when the blocks are positioned within predetermined indentations, respectively, and a changing of a fixed longitudinal positioning of the blocks relative to the tumblers being enabled by changing the predetermined code of the key only when the blocks are located in the indentations; and a cylindrical key having a shaft with a plurality of lugs positioned thereon, the lugs each being independently rotationally variable relative to the shaft for engaging predetermined of the tumblers and wherein the shaft includes a selectively movable lug for selectively enabling the key to be removed from the orifice when the blocks are located in the indentations, whereby the predetermined code can be changed only when the lug is moved to a predetermined radial position on the shaft.

2. A lock as set forth in claim 1 wherein each of the tumblers includes means for normally biasing the tumblers towards the orifice.

3. A lock as set forth in claim 1 wherein the key includes a handle and a cylindrical shaft projecting therefrom for insertion into the orifice, the shaft including a plurality of concentric sleeves each having at least one lug disposed thereon and disposed longitudinally in succession along the shaft, each of the lugs extending radially outwardly at a sufficient distance to engage and longitudinally displace predetermined tumblers when the shaft is inserted into the orifice.

4. A lock as set forth in claim 3 wherein the key includes means for rotatably varying the circumferential position of each of the sleeves to engage a predetermined tumbler.

5. A lock as set forth in claim 4 wherein the means for rotatably varying includes a splined key shaft and interengaging shoulders upon the sleeves that each normally fix the sleeves rotationally relative to the shaft and that allow rotation of the sleeves by application of a predetermined torsional force.

6. A lock as set forth in claim 3 wherein the key shaft includes a cylindrical lumen for engagement of a guiding rod disposed coaxially with and rotationally fixed relative to the drum.

7. A lock as set forth in claim 6 further comprising projections upon the lumen and corresponding ridges upon the guiding rod for accepting the projections for allowing transfer of torque directly from the key shaft to the guiding rod.

8. A lock as set forth in claim 3 further comprising a rear sleeve proximate the handle including a first rear lug disposed radially outwardly further than the plurality of sleeves.

9. A lock as set forth in claim 8 further comprising a rim disposed at the orifice including a through-cut notch at a predetermined circumferential location thereon for allowing the first rear lug of a key to enter the orifice while other circumferential locations of the rim interfere with first rear lug entry.

10. A lock as set forth in claim 9 further comprising a second rear lug upon the rear sleeve adapted to be selectably extended and retracted and the rim including second circumferentially corresponding through-cut notch thereon for allowing the key to enter and exit only in one predetermined circumferential position when the second rear lug is extended.

11. A lock as set forth in claim 10 wherein the second notch is positioned circumferentially so that when the second rear lug is retracted the shaft may be completely removed from the orifice with the first rear lug exiting from the second notch, the removal of the shaft from the second notch being at a circumferential position in which the blocks are within the indentations.

12. A lock as set forth in claim 11 wherein there are ten slots and ten corresponding grooves and wherein the first notch and second notch are oriented circumferentially at a 90° angle to each other.

13. A lock as set forth in claim 8 wherein the rear sleeve is spaced radially about a circumference outwardly at a distance sufficient to engage each of the tumblers when the key shaft is inserted into the orifice.

14. A lock as set forth in claim 1 further comprising a guiding rod disposed coaxially within and rotationally fixed relative to the drum for accommodating a hollow centrally disposed portion of the key shaft.

15. A lock as set forth in claim 14 further comprising means, disposed upon each of the guiding rod and hollow centrally disposed portion of the key shaft, for allowing transfer of torque directly from the key shaft to the guiding rod.

16. A lock as set forth in claim 1 further comprising a rim disposed at the orifice including a notch positioned at a predetermined circumferential location for allowing a predetermined lug of the key to enter the orifice while other circumferential locations of the rim interfere with entry of the lug.

* * * * *